US008312914B2

(12) United States Patent
Walker et al.

(10) Patent No.: US 8,312,914 B2
(45) Date of Patent: Nov. 20, 2012

(54) METHOD, MOLD, AND MOLD SYSTEM FOR FORMING ROTORS

(75) Inventors: Michael J. Walker, Windsor (CA); Anil K. Sachdev, Rochester Hills, MI (US); Thomas A. Perry, Bruce Township, MI (US); Mark A. Osborne, Grand Blanc, MI (US); Paul Boone, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 330 days.

(21) Appl. No.: 12/785,796

(22) Filed: May 24, 2010

(65) Prior Publication Data

US 2011/0284138 A1 Nov. 24, 2011

(51) Int. Cl.
*B22D 19/00* (2006.01)
*B22D 19/04* (2006.01)

(52) U.S. Cl. ..... 164/333; 164/334; 164/109

(58) Field of Classification Search ..... 164/271, 164/332, 333, 334, 339, 108, 109, 110, 112; 249/119, 135

See application file for complete search history.

(56) References Cited

U.S. PATENT DOCUMENTS

| | | | | |
|---|---|---|---|---|
| 4,158,225 | A * | 6/1979 | Hertz | 363/150 |
| 5,467,521 | A * | 11/1995 | Nakamura et al. | 29/598 |
| 5,950,706 | A * | 9/1999 | Choudhury et al. | 164/290 |
| 6,453,980 | B1 * | 9/2002 | Williams | 164/137 |
| 2010/0007234 | A1 | 1/2010 | Alfermann et al. | |

* cited by examiner

*Primary Examiner* — Kevin P Kerns
(74) *Attorney, Agent, or Firm* — Quinn Law Group, PLLC

(57) ABSTRACT

A mold for forming a plurality of rotors includes a plurality of lamination stacks, wherein each lamination stack defines at least one void therethrough; a tube having a central longitudinal axis, wherein each lamination stack is concentrically spaced apart from the tube to define a channel therebetween; a plurality of washers each having a shape defined by a first diameter and a second diameter that is greater than the first diameter, wherein each washer is configured to concentrically abut the tube and define a feed conduit interconnecting with the channel; and a shell disposed in contact with each lamination stack and concentrically spaced apart from each washer to define a plurality of ducts, wherein each duct is interconnected with the at least one void of at least one lamination stack. A mold system and a method of forming a plurality of rotors are also described.

11 Claims, 6 Drawing Sheets

METHOD, MOLD, AND MOLD SYSTEM FOR FORMING ROTORS

TECHNICAL FIELD

The present disclosure generally relates to a mold, a mold system, and a method for forming a plurality of rotors.

BACKGROUND

Electric motors convert electrical energy to mechanical energy through an interaction of magnetic fields and current-carrying conductors. In contrast, generators, often referred to as dynamos, convert mechanical energy to electrical energy. Further, other electric machines, such as motor/generators and traction motors, may combine various features of both motors and generators.

Such electric machines may include an element rotatable about a central axis. The rotatable element, e.g., a rotor, may be coaxial with a static element, e.g., a stator. One type of rotor, a squirrel-cage rotor, may have a cage-like shape and include multiple longitudinal conductive rotor bars disposed between and connected to two rotor end rings. Such electric machines use relative rotation between the rotor and stator to produce mechanical energy or electric energy.

SUMMARY

A mold for forming a plurality of rotors includes a plurality of lamination stacks, wherein each lamination stack defines at least one void therethrough. The mold also includes a tube having a central longitudinal axis, wherein each lamination stack is concentrically spaced apart from the tube to define a channel therebetween. The mold also includes a plurality of washers each having a shape defined by a first diameter and a second diameter that is greater than the first diameter. Each washer is configured to concentrically abut the tube and define a feed conduit interconnecting with the channel. Additionally, the mold includes a shell disposed in contact with each lamination stack and concentrically spaced apart from each washer to define a plurality of ducts, wherein each duct is interconnected with the at least one void of at least one lamination stack.

A mold system for forming a plurality of rotors includes the mold configured to receive a metal flowable within the mold so as to substantially fill each void, channel, feed conduit, and duct, and a first furnace configured for heating the mold to a first temperature. The mold system also includes a second furnace configured for heating the metal to a flowable state and counter-gravity filling the mold with the metal in the flowable state along the central longitudinal axis. Further, the mold system includes a cooling device configured for cooling the mold progressively along the central longitudinal axis to thereby directionally solidify the metal along the central longitudinal axis.

A method of forming a plurality of rotors includes counter-gravity filling the mold with a metal having flow defined by minimized turbulence to form a workpiece, quenching the workpiece progressively along the central longitudinal axis to directionally solidify the metal along the central longitudinal axis and thereby form a cast defining a plurality of pores present in the cast in an amount of from about 0.001 parts by volume to about 5 parts by volume based on 100 parts by volume of the cast, and finishing the cast to thereby form the plurality of rotors.

The mold, mold system, and method allow for counter-gravity filling of the mold with the metal having a flow defined by minimized turbulence, and directional solidification of the metal during formation of the rotors. Therefore, the mold, mold system, and method form a plurality of rotors each having minimized porosity, excellent strength, minimized hot tears and shrinkage defects, and maximized conductivity. Consequently, the mold, mold system, and method form rotors that are easily balanced in electric machines and are therefore useful for applications requiring excellent electric machine efficiency. Further, the method forms rotors at low-pressure using economical tooling, and provides excellent metal yield. The mold, mold system, and method also form a plurality of rotors at once and thereby optimize rotor production speed.

The above features and advantages and other features and advantages of the present disclosure are readily apparent from the following detailed description of the best modes for carrying out the disclosure when taken in connection with the accompanying drawings.

DETAILED DESCRIPTION

Figure 1:
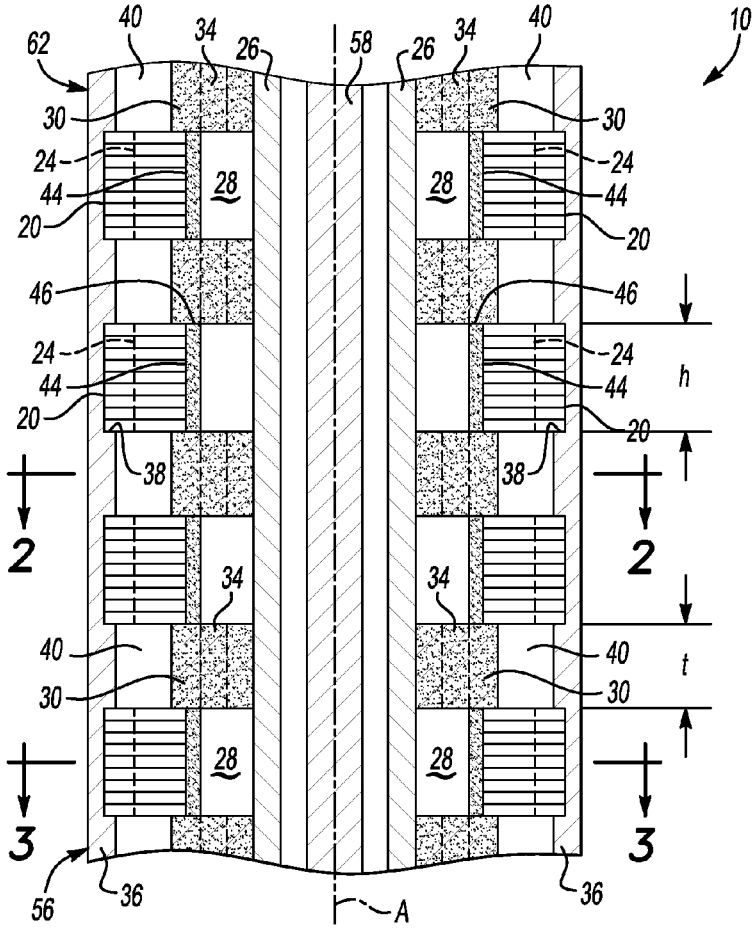
FIG. 1 is a schematic fragmentary cross-sectional view of a mold for forming a plurality of rotors.

Referring to the Figures, wherein like reference numerals refer to like elements, a mold 10 is shown generally in FIG. 1. The mold 10 is useful for forming a plurality of rotors 12 (FIG. 4) each having minimized porosity and excellent strength and conductivity. Therefore, the mold 10 may be useful for a variety of applications requiring rotors 12 (FIG. 4), such as, but not limited to, electric machines such as electric motors and generators. For example, the mold 10 forms a plurality of rotors 12 (FIG. 4) each useful for an induction motor for a vehicle.

By way of general explanation, and described with reference to FIG. 4, each rotor 12 may include a plurality of longitudinal conductive rotor bars 14 connected respectively at opposite ends to two end rings 16. Further, each rotor 12 may include a core 18 formed from lamination stacks, shown generally at 20 in FIG. 1 and set forth in more detail below.

Referring now to FIG. 1, the mold 10 includes a plurality of lamination stacks 20. Each lamination stack 20 may include a plurality of lamination steels, shown generally at 22 in FIG. 5. As used herein, the terminology "lamination steel" refers to steel, often including silicon, tailored to produce desired magnetic properties, e.g., low energy dissipation per cycle and/or high permeability, and suitable for carrying magnetic flux. For example, lamination steels 22 (FIG. 5) may be die cut into circular layers or laminations having a thickness of less than or equal to about 2 mm. Referring to FIG. 1, the circular layers may then be stacked adjacent one another to form the lamination stack 20. That is, referring now to FIG. 4, the lamination stack 20 (FIG. 1) may be in the form of cold-rolled strips of lamination steel stacked together to form the core 18 of the rotor 12.

Figure 4:
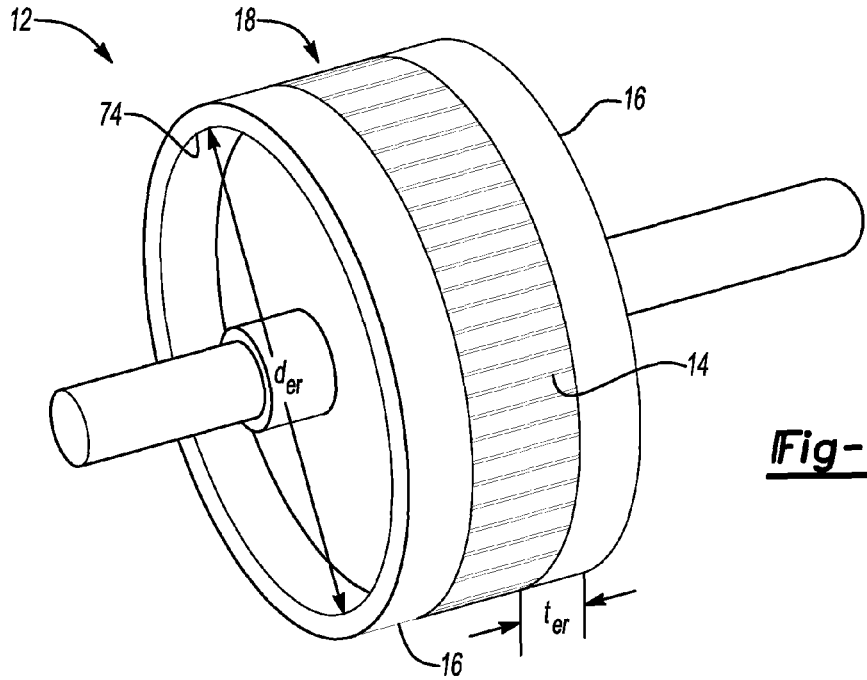
FIG. 4 is a schematic perspective view of a rotor formed by the mold of FIG. 1, wherein the rotor includes a core formed from a plurality of lamination steels.
Figure 5:
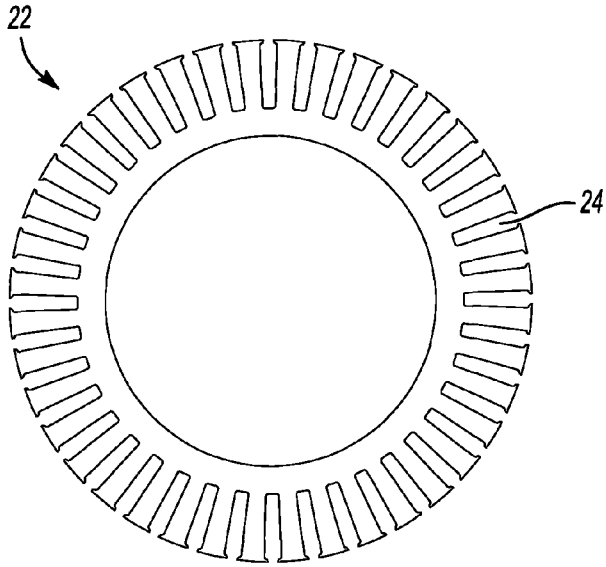
FIG. 5 is a schematic top planar view of one lamination steel of the rotor of FIG. 4.

Further, referring to FIGS. 1 and 5, each lamination stack 20 defines at least one void 24 therethrough. That is, as set forth above, individual lamination steels 22 may be stacked adjacent one another so as to define at least one void 24 through the lamination stack 20. For example, each lamination stack 20 may define a plurality of voids 24 disposed in an arrangement corresponding to a shape and/or configuration of the rotor bars 14 (FIG. 4) of each rotor 12 (FIG. 4).

Referring again to FIG. 1, the mold 10 may include any number of lamination stacks 20. Generally, the mold 10 may include one lamination stack 20 for each rotor 12 (FIG. 4) to be formed. Therefore, the mold 10 may include a number of lamination stacks 20 corresponding to a number of desired rotors 12 (FIG. 4) to be formed by the mold 10.

Referring to FIG. 1, the mold 10 also includes a tube 26 having a central longitudinal axis A. Each lamination stack 20 is concentrically spaced apart from the tube 26 to define a channel 28 therebetween. As used herein, the terminology "concentrically" refers to elements disposed in a concentric manner, i.e., elements having a common center. Therefore, each lamination stack 20 is spaced apart from the tube 26 to form a concentric ring around the tube 26 with respect to the central longitudinal axis A. The tube 26 may be hollow, and may be formed from a non-metal, e.g., bonded sand or ceramic. Alternatively, the tube 26 may be formed from a metal, e.g., steel.

Figure 2:
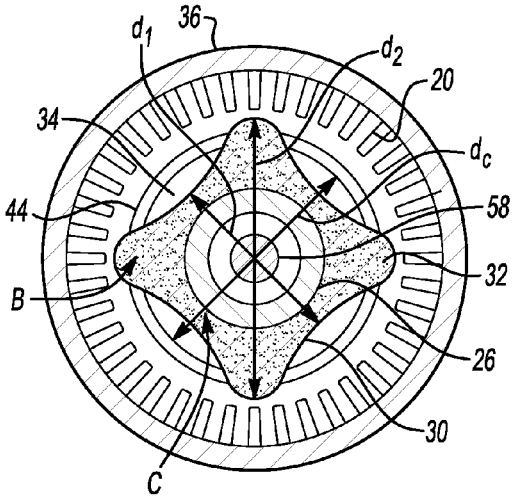
FIG. 2 is a schematic cross-sectional view of the mold of FIG. 1 along section line 2-2.

Referring again to FIG. 1, the mold 10 further includes a plurality of washers 30. As best shown in FIG. 2, each washer 30 has a shape defined by a first diameter, $d_1$, and a second diameter, $d_2$, that is greater than the first diameter, $d_1$. For example, although other shapes are possible, each washer 30 may include four lobes 32 defined by the first diameter, $d_1$, and the second diameter, $d_2$. Alternatively, each washer 30 may include any number of lobes 32, e.g., one lobe 32, three lobes 32, or more than four lobes 32. That is, each washer 30 may have any shape, e.g., an irregular star shape or a triangular shape.

Referring to FIG. 1, each washer 30 is configured to concentrically abut the tube 26 and define a feed conduit 34 interconnecting with the channel 28. That is, each washer 30 is configured to contact the tube 26 to form a concentric ring around the tube 26 with respect to the central longitudinal axis A. Therefore, each of the plurality of washers 30 may be hollow and may be formed from a non-metal, e.g., bonded sand or ceramic.

As shown in FIG. 1, the feed conduit 34 may be interconnected with at least one channel 28. Depending on the location of the washer 30 within the mold 10, the feed conduit 34 may also interconnect two channels 28. For example, for a washer 30 sandwiched between lamination stacks 20, the feed conduit 34 may interconnect exactly two channels, i.e., one channel 28 disposed directly above the washer 30 and one channel 28 disposed directly below the washer 30 within the mold 10.

Referring now to FIG. 2, since the second diameter, $d_2$, of each washer 30 is greater than the first diameter, $d_1$, each washer 30 overlaps a portion (shown generally at arrow B in FIG. 2) of each lamination stack 20. Similarly, since the first diameter, $d_1$, of each washer 30 is less than the second diameter, $d_2$, each washer 30 also does not overlap another portion (shown generally at arrow C in FIG. 2) of each lamination stack 20 and thereby defines the feed conduit 34 that communicates with the channel 28 (FIG. 1).

Referring to FIGS. 1 and 4, each washer 30 may have a thickness, t (FIG. 1), equal to a sum of a thickness, $t_{er}$ (FIG. 4), of each of two rotor end rings 16 (FIG. 4) plus any additional thickness (not shown) of machining stock to provide for separation of adjacent rotors 12 after formation, as set forth in more detail below. Alternatively, each washer 30 may have a thickness, t (FIG. 1), equal only to the sum of the thickness, $t_{er}$ (FIG. 4), of each of two rotor end rings 16 (FIG. 4), without allowance for additional machining stock. In this variation, the mold 10 may include additional components, such as placeholders (not shown), disposed adjacent and in contact with each washer 30 to define an inner diameter, $d_{er}$ (FIG. 4), of the rotor end ring 16 (FIG. 4). In this variation, machining may include operations such as shearing or sawing of the rotor end ring 16 (FIG. 4).

Figure 3:
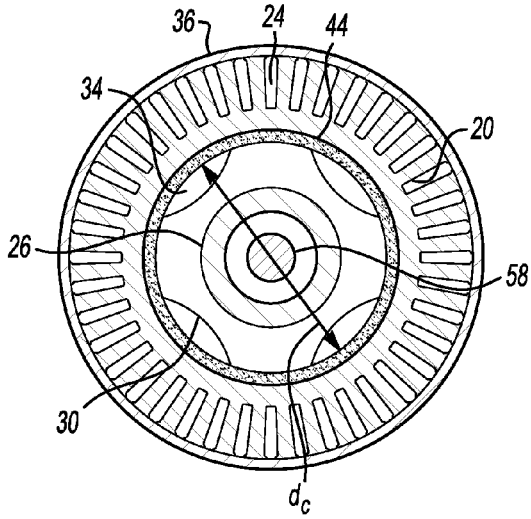
FIG. 3 is a schematic cross-sectional view of the mold of FIG. 1 along section line 3-3.

Referring now to FIGS. 1 and 3, the mold 10 also includes a shell 36 disposed in contact with each lamination stack 20. That is, the shell 36 may form an exterior of the mold 10 and thereby surround and contact the plurality of lamination stacks 20 disposed within the shell 36. Therefore, the shell 36 contacts each lamination stack 20 to form a concentric ring around the plurality of lamination stacks 20 with respect to the central longitudinal axis A (FIG. 1). As such, the shell 36 may be hollow and may be formed from a metal, e.g., steel. The shell 36 may also define an indentation 38 that is sized equivalent to a height, h, (FIG. 1) of each lamination stack 20. Therefore, each lamination stack 20 may be supported by one indentation 38 of the shell 36.

Further, with reference to FIG. 1, the shell 36 is concentrically spaced apart from each washer 30 to define a plurality of ducts 40. As shown in FIG. 1, each duct 40 is interconnected with the at least one void 24 of at least one lamination stack 20 to allow communication between the duct 40 and the at least one void 24. Depending on the location of the duct 40 within the mold 10, one duct 40 may also interconnect with the at least one void 24 of exactly two lamination stacks 20, i.e., the at least one void 24 of one lamination stack 20 disposed directly above the duct 40 and the at least one void 24 of one lamination stack 20 disposed directly below the duct 40 within the mold 10.

Figure 6:
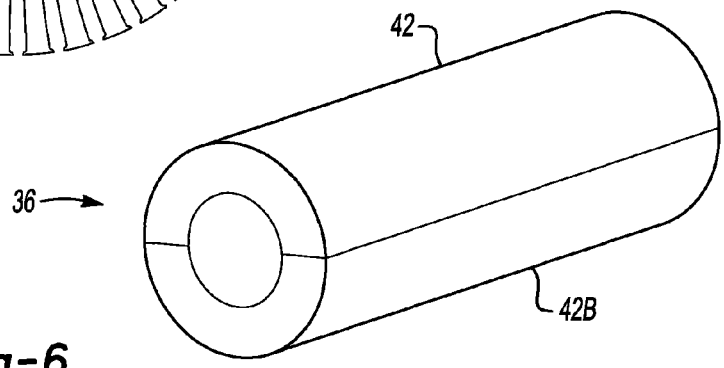
FIG. 6 is a schematic perspective view of a shell of the mold of FIG. 1.

Referring to FIG. 6, for ease of assembly, the shell 36 may be separable into a first portion 42 and a second portion 42B. For example, the shell 36 may be separable into two halves, i.e., the first portion 42 and the second portion 42B, along a central longitudinal plane so that the first portion 42 is a mirror image of the second portion 42B. By way of a non-limiting example, the first portion 42 may be snap fit, interference fit, and/or removably attached by a fastener to the second portion 42B.

In one variation, the mold 10 may further include a plurality of spacers 44, as shown in FIG. 1. More specifically, each spacer 44 may abut one lamination stack 20 and may be concentrically spaced apart from the tube 26 and disposed within the channel 28. That is, in this variation, each spacer 44 is spaced apart from the tube 26 within each respective channel 28, and forms a concentric ring around the tube 26 with respect to the central longitudinal axis A. And, referring to FIG. 1, each spacer 44 abuts an internal surface of one lamination stack 20 to space the lamination stack 20 apart from the tube 26 within the channel 28. That is, the mold 10 may include one spacer 44 for each lamination stack 20. Each of the plurality of spacers 44 may be hollow and may be formed from a non-metal, e.g., bonded sand or ceramic.

Further, as best shown in FIG. 3, each spacer 44 may have a shape defined by an internal diameter, $d_c$. For example, as shown in FIG. 3, each spacer 44 may have a cylindrical shape. Additionally, as shown in FIG. 2, the first diameter, $d_1$, of each washer 30 may be less than the internal diameter, $d_c$, of each spacer 44, and the second diameter, $d_2$, of each washer 30 may be greater than the internal diameter, $d_c$.

In this variation, each washer 30 also at least partially abuts at least one spacer 44 so that the feed conduit 34 interconnects with the channel 28. For example, each washer 30 may contact an upper edge 46 (FIG. 1) of one spacer 44, i.e., be disposed above the spacer 44 within the mold 10 with respect to section line 2-2 in FIG. 1. Alternatively, one washer 30 may abut two spacers 44. That is, one washer 30 may be sandwiched between two spacers 44.

Therefore, in this variation as described with reference to FIGS. 2 and 3, since the second diameter, $d_2$, of each washer 30 is greater than the internal diameter, $d_c$, of each spacer 44, each washer 30 overlaps a portion (shown generally at arrow B in FIG. 2) of each spacer 44 to block communication between the feed conduit 34 and the channel 28 (FIG. 1). Similarly, since the first diameter, $d_1$, of each washer 30 is less than the internal diameter, $d_c$, of each spacer 44, each washer 30 also does not overlap another portion (shown generally at arrow C in FIG. 2) of each spacer 44 and thereby defines the feed conduit 34 that communicates with the channel 28 (FIG. 1).

As shown in FIG. 1, in this variation, the feed conduit 34 may be interconnected with at least one channel 28. However, depending on the location of the washer 30 and the spacers 44 within the mold 10, the feed conduit 34 may also interconnect two channels 28. For example, for a washer 30 sandwiched between two spacers 44, the feed conduit 34 may interconnect exactly two channels 28, i.e., one channel 28 disposed directly above the washer 30 and one channel 28 disposed directly below the washer 30 within the mold 10.

Figure 7:
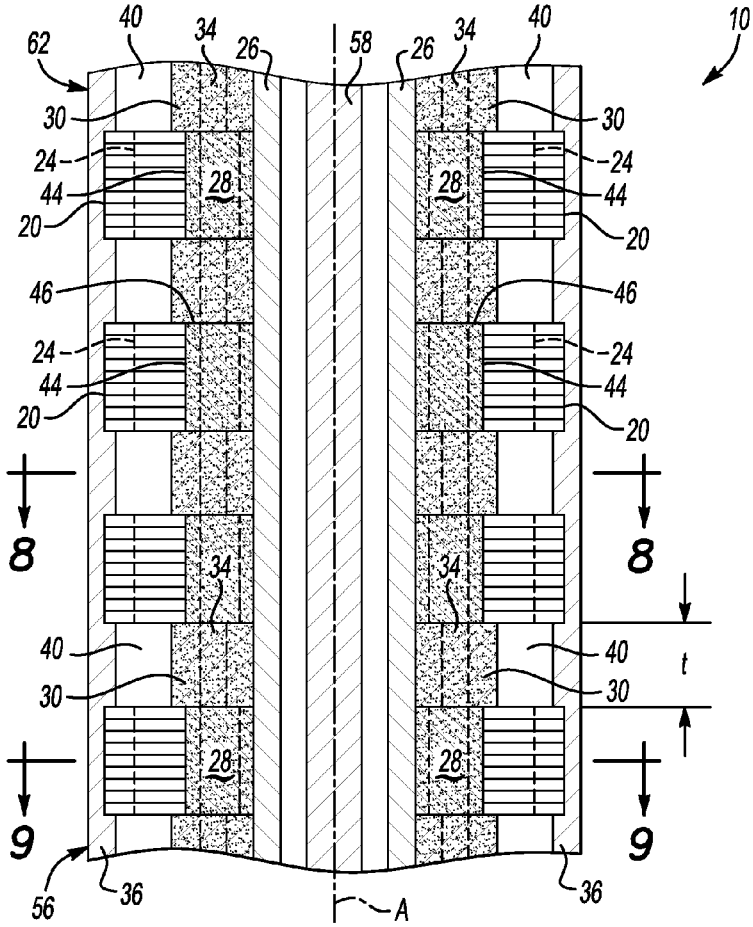
FIG. 7 is a schematic fragmentary cross-sectional view of a variation of the mold of FIG. 1.
Figure 8:
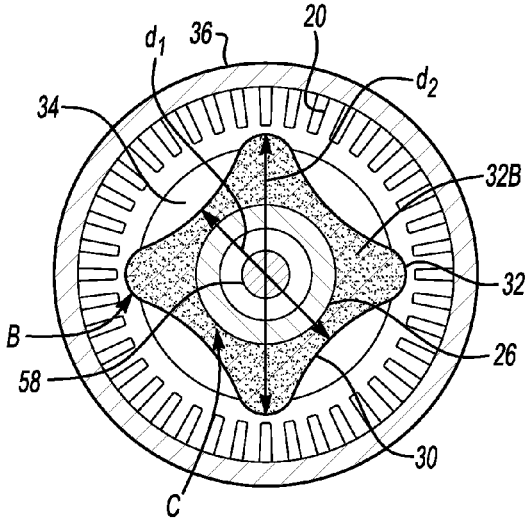
FIG. 8 is a schematic cross-sectional view of the mold of FIG. 7 along section line 8-8.
Figure 9:
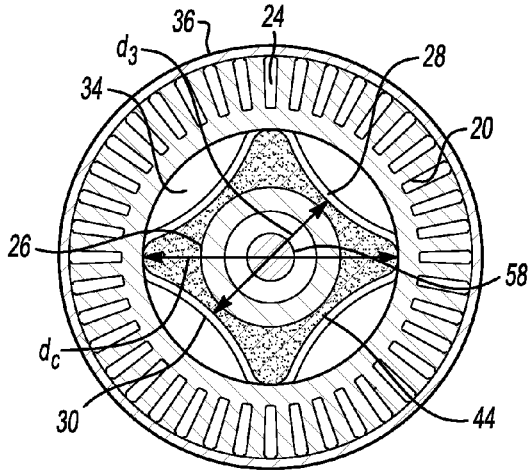
FIG. 9 is a schematic cross-sectional view of the mold of FIG. 7 along section line 9-9.

Referring now to FIGS. 7-9, in another variation, the mold 10 may further include a plurality of spacers 44 each having a shape defined by the internal diameter, $d_c$, (FIG. 9) and a third diameter, $d_3$, (FIG. 9). More specifically, as best shown in FIG. 9, the third diameter, $d_3$, may be less than the internal diameter, $d_c$, of the spacer 44 and less than or equal to the first diameter, $d_1$, (FIG. 8) of each washer 30. That is, the spacer 44 may have a similar shape as the washer 30, but may be smaller in size than the washer 30. For example, as best shown in FIGS. 8 and 9, the spacer 44 may have the same number of lobes 32B (FIG. 8) as the washer 30, and the lobes 32B of the spacer 44 may align with the lobes 32 of the washer 30. In this variation, each spacer 44 may abut one lamination stack 20 and the tube 26, and may be disposed within the channel 28. Therefore, in this variation, as best shown in FIG. 9, each spacer 44 abuts the respective lamination stack 20, is supported by each washer 30, and is disposed within the channel 28 (FIG. 7) so as to interconnect the feed conduit 34 with the channel 28 (FIG. 7) and decrease an open volume of the channel 28.

Figure 10:
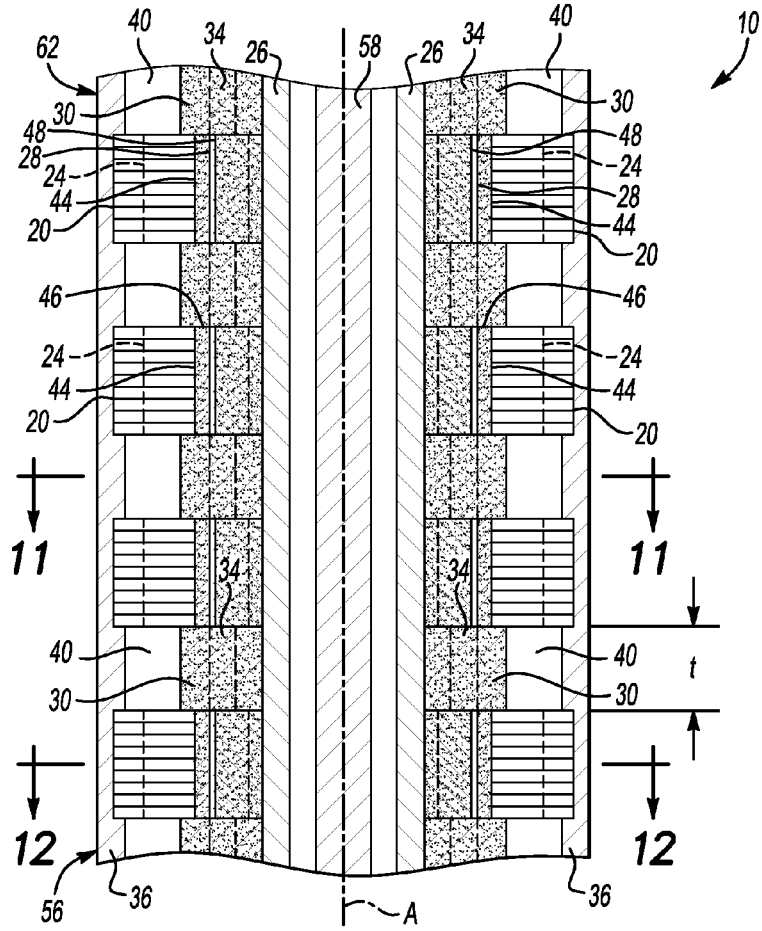
FIG. 10 is a schematic fragmentary cross-sectional view of another variation of the mold of FIG. 1.
Figure 11:
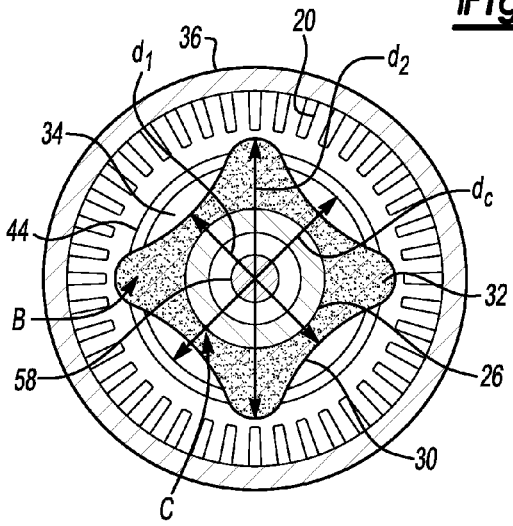
FIG. 11 is a schematic cross-sectional view of the mold of FIG. 10 along section line 11-11.
Figure 12:
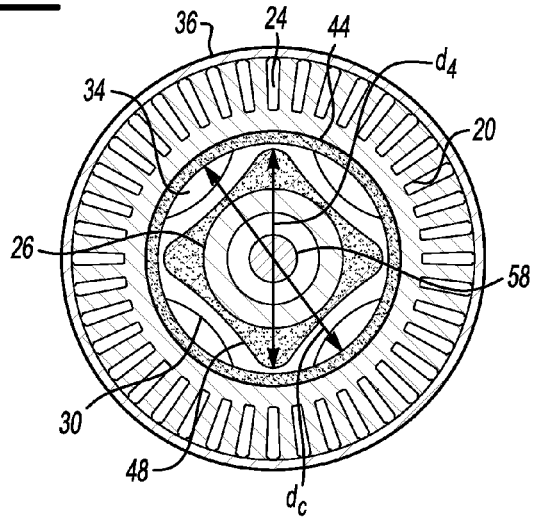
FIG. 12 is a schematic cross-sectional view of the mold of FIG. 10 along section line 12-12.

In yet another variation, as shown in FIGS. 10-12, the mold 10 may further include a member 48 (FIG. 12) having a shape defined by a fourth diameter, $d_4$, (FIG. 12) that is less than the internal diameter, $d_c$, of each spacer 44. For example, in this variation, the mold 10 may include the member 48 having a shape similar to each washer 30, but sized smaller than each washer 30. In this variation, the mold 10 may include both the spacer 44 in the aforementioned cylindrical form, and the member 48. Referring to FIG. 12, since the fourth diameter, $d_4$, of the member 48 is less than the internal diameter, $d_c$, of each spacer 44, the member 48 may fit inside the spacer 44 in cylindrical form so as to be supported by each washer 30, be disposed within the channel 28 (FIG. 10), interconnect the feed conduit 34 with the channel 28 (FIG. 10), and decrease an open volume of the channel 28 (FIG. 10).

Therefore, it is to be appreciated that each of the plurality of spacers 44 may have any other shape, as long as the each spacer 44 concentrically abuts a respective lamination stack 20 and the tube 26 within each respective channel 28.

Figure 13:
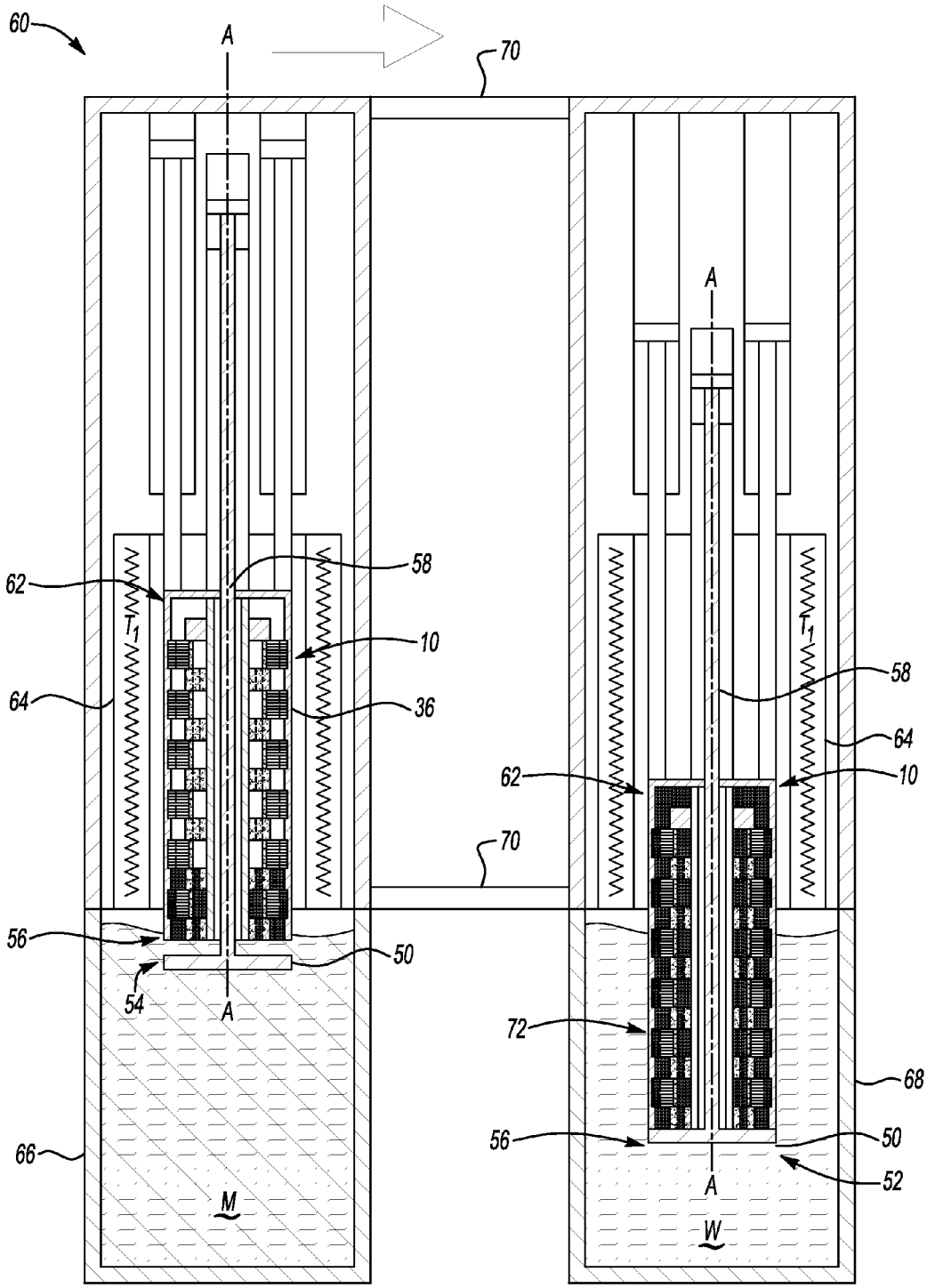
FIG. 13 is a schematic cross-sectional view of a mold system showing a counter-gravity filling arrangement for filling the mold of FIG. 1.

As best shown in FIG. 13, the mold 10 may further include a valve 50 configured for sealing the mold 10. The valve 50 may any suitable device that is actuatable to transition between a sealed position (shown at 52 in FIG. 13) and an open position (shown at 54 in FIG. 13). That is, by way of a non-limiting example, the valve 50 may be a plate disposed along an open distal end 56 of the mold 10 that sealingly communicates with the shell 36 to close off the distal end 56 of the mold 10. In other examples (not shown), the valve 50 may be a wedge, a gate, and/or a slot defined by the mold 10 that is configured to seal the mold 10. In another example, the valve 50 may be configured to seal the mold 10 as a material, e.g., sand or solid metal, moves across the distal end 56 of the mold 10. Although not shown, in another example, the mold 10 may taper to a reduced diameter to define an internal valve 50, e.g., a gate. In this variation, the gate may be chilled at the reduced diameter to freeze and seal the gate during processing operations including the mold 10.

With continued reference to FIGS. 1 and 13, the mold 10 may also include a rod 58 disposed within the tube 26 along the central longitudinal axis A and configured for actuating the valve 50 (FIG. 13). That is, the rod 58 may be connected to the valve 50 (FIG. 13), e.g., the aforementioned plate, and moveable along the central longitudinal axis A to actuate and transition the valve 50 (FIG. 13) between the sealed position (shown at 52 in FIG. 13) and the open position (shown at 54 in FIG. 13).

When the mold 10 is assembled, as described with reference to FIG. 1, the aforementioned individual components are stacked in adjacent rings between the tube 26 and shell 36, concentric with the central longitudinal axis A. For example, in preparation for forming exactly two rotors 12 (FIG. 4), two lamination stacks 20 are sandwiched between a total of three washers 30. Each of the two lamination stacks 20 abut the shell 36, and each of the three washers 30 abut the tube 26. Likewise, for the variation including spacers 44, in preparation for forming exactly two rotors 12 (FIG. 4), two spacers 44 abut two lamination stacks 20 and are sandwiched between a total of three washers 30. Similarly, the aforementioned sequence of washers 30, lamination stacks 20, and/or spacers 44 and members 48 may be repeated to form more than two rotors 12 (FIG. 4), i.e., the plurality of rotors 12 (FIG. 4).

Referring now to FIG. 13, a mold system 60 for forming the plurality of rotors 12 (FIG. 4) includes the mold 10, wherein the mold 10 is configured to receive a metal (designated by hatched area M) flowable within the mold 10 so as to substantially fill each void 24 (FIGS. 1 and 3), channel 28 (FIG. 1), feed conduit 34 (FIG. 1), and duct 40 (FIG. 1). That is, as best shown in FIG. 1, since each of the at least one void 24 of each lamination stack 20 is interconnected by a duct 40, and since each of the channels 28 is connected to a feed conduit 34, the metal M (FIG. 13) may flow from the distal end 56 of the mold 10 to a proximal end 62 of the mold 10 to substantially fill each void 24, channel 28, feed conduit 34, and duct 40.

Referring to FIG. 13, the metal M may be electrically conductive and may be suitable for forming the plurality of rotors 12 (FIG. 4). For example, the metal M may be aluminum, copper, and combinations and alloys thereof. In particular, by way of non-limiting examples, the metal M may be selected from the group of aluminum alloy 6101, aluminum alloy A170, and combinations thereof.

The metal M may be transitionable between a liquid state having comparatively low viscosity, a semi-solid state having a two-phase mixture of a solid fraction and a liquid fraction, and a solid state having comparatively high viscosity. That is, metal M in the liquid state generally has a viscosity that is lower than metal M in each of the semi-solid state and the solid state. Therefore, metal M in the liquid state requires significantly less force to flow as compared to metal M in the solid state. And, metal M in a semi-solid state including the solid fraction has a comparatively higher viscosity than metal M in the liquid state, and therefore requires comparatively more force to flow. That is, as the fraction of solids in metal M in the semi-solid state increases, viscosity also increases, and the metal M requires increasingly more force to flow.

Further, the metal M may have a liquidus temperature, $T_{liq}$, and a solidus temperature, $T_s$. As used herein, the terminology "liquidus temperature" refers to a maximum temperature at which crystals can co-exist with melted metal M in thermodynamic equilibrium. Stated differently, above the liquidus temperature, $T_{liq}$, the metal M is homogeneous and flowable and no solid fraction is present. And, as used herein, the terminology "solidus temperature" refers to a temperature at which the metal M begins to melt, i.e., change from the solid state to the liquid state. Between the solidus temperature, $T_s$, and the liquidus temperature, $T_{liq}$, the metal M may exist in the semi-solid state. And, at temperatures near, but above, the solidus temperature, $T_s$, metal M in the semi-solid state may include the liquid fraction. Similarly, at temperatures near, but below, the liquidus temperature, $T_{liq}$, metal in the semi-solid state may include the solid fraction.

As stated above, the metal M is flowable within the mold 10, and the flow may be free from excessive turbulence as set forth in more detail below. In one non-limiting example, the metal M may have substantially laminar flow. As used herein, the terminology "laminar flow" refers to flow of the metal M characterized by nonturbulent, streamline, parallel layers. Stated differently, the metal M may exhibit flow defined by minimized turbulence within each void 24 (FIGS. 1 and 3), channel 28 (FIG. 1), feed conduit 34 (FIG. 1), and duct 40 (FIG. 1) before completely transitioning to the solid state within the mold 10. Therefore, as set forth in more detail below, the metal M in each of the liquid state, the semi-solid state, and the solid state is substantially free from air pockets and porosity caused by excessive turbulence such as in die casting.

Referring again to FIG. 13, the mold system 60 also includes a first furnace 64 configured for heating the mold 10 to a first temperature, $T_1$. Generally, the first temperature, $T_1$, is selected to allow flow of the metal M within the mold 10. Therefore, the first furnace 64 may be useful for preheating the mold 10 before additional processing operations set forth in more detail below. The first furnace 64 may be configured to receive and surround the mold 10 to heat the mold 10 to the first temperature, $T_1$, of from about 500° C. to about 1,300° C. That is, for applications including aluminum or aluminum alloys, the first temperature, $T_1$, may be from about 500° C. to about 800° C. e.g., about 660° C. And, for applications including copper or copper alloys, the first temperature, $T_1$, may be from about 900° C. to about 1,300° C., e.g., about 1,150° C. The first furnace 64 may be fired by any suitable fuel, and may heat the mold 10 by at least one of convection heating, conduction heating, induction heating, and radiation heating.

Additionally, the mold system 60 includes a second furnace, shown generally at 66 in FIG. 13. The second furnace 66 is configured for heating the metal M to a flowable state. For applications including aluminum or aluminum alloys, the second furnace 66 may be configured to heat the metal M to a temperature of from about 550° C. to about 800° C., e.g., about 680° C. And, for applications including copper or copper alloys, the second furnace 66 may be configured to heat the metal M to a temperature of from about 1,000° C. to about 1,300° C., e.g., about 1,200° C. Therefore, the second furnace 66 may be useful for heating the metal M after the mold 10 has been preheated to the first temperature, $T_1$, by the first furnace 64, as set forth in more detail below. The second furnace 66 may also be fired by any suitable fuel, and may heat the metal M by at least one of convection heating, conduction heating, induction heating, and radiation heating.

The second furnace 66 is configured for counter-gravity filling the mold 10 with the metal M in the flowable state along the central longitudinal axis A. As used herein, the terminology "counter-gravity filling" refers to invertedly filling the mold 10. That is, the second furnace 66 may be configured to receive and surround the mold 10 so as to fill the distal end 56 of the mold 10 with the metal M before the proximal end 62 of the mold 10. Therefore, the second furnace 66 may also be pressurizeable and may be configured to contain the metal M. The second furnace 66 may also include a mechanical or electromagnetic pumping system (not shown) configured for counter-gravity filling the mold 10.

Referring again to FIG. 13, the mold system 60 also includes a cooling device 68 configured for cooling the mold 10 progressively along the central longitudinal axis A to thereby directionally solidify the metal M along the central longitudinal axis A. For example, the cooling device 68 may cool the metal M to below the solidus temperature, $T_s$, of the metal M so that the metal M cools in a direction along the central longitudinal axis A. That is, the cooling device 68 may be any suitable device for lowering the temperature of the mold 10 to thereby cool the metal M to a non-flowable state below the solidus temperature, $T_s$, of the metal M to thereby promote directional solidification of the metal M in a direction along the central longitudinal axis A. For example, the temperature of the mold 10 may be lowered to below about 350° C. for applications including aluminum or aluminum alloys and to below about 325° C. for applications including copper or copper alloys. In one example, the cooling device 68 may be a quench tank configured for receiving and quenching the mold 10. The cooling device 68 may contain a suitable cooling fluid W, e.g., water. Alternatively, in another variation, the cooling device 68 may be a series of spray nozzles (not shown) configured for dousing the mold 10 with the suitable cooling fluid W, e.g., water or air.

As set forth above, the cooling device 68 is configured for cooling the mold 10 progressively along the central longitudinal axis A. That is, the cooling device 68 may cool the distal end 56 of the mold 10 before the proximal end 62 of the mold 10. Stated differently, the cooling device 68 may be configured to first cool the distal end 56 of the mold 10, then progressively cool the mold 10 along the central longitudinal axis A in a direction towards the proximal end 62 of the mold 10. Alternatively, the cooling device 68 may cool the proximal end 62 of the mold 10 before cooling the distal end 56 of the mold 10.

As set forth in more detail below, the first furnace 64, the second furnace 66, and the cooling device 68 may be co-located to allow for ease of transport of the mold 10 between each device. Moreover, the first furnace 64 may be moveable between the second furnace 66 and the cooling device 68 so as to transport the mold 10 and the first furnace 64 between each device. For example, a linear actuator, shown generally at 70 in FIG. 13, may alternatively position the first furnace 64 above the second furnace 66 or the cooling device 68. Alternatively, the second furnace 64 and/or the cooling device 68 may be moveable with respect to the first furnace 64 and/or the mold 10.

A method of forming the plurality of rotors 12 (FIG. 4) is described with reference to FIG. 13. The method includes counter-gravity filling the mold 10 with the metal M having flow defined by minimized turbulence to form a workpiece 72, i.e., a work-in-process. That is, as used herein, the terminology "workpiece" refers to a precursor of the plurality of rotors 12 (FIG. 4) that includes the metal M within the mold 10 in an unfinished state so as to requiring further processing operations.

In particular, counter-gravity filling may insert the metal M having flow defined by minimized turbulence into the mold 10 progressively along the central longitudinal axis A from the distal end 56 to the proximal end 62 of the mold 10. For example, counter-gravity filling may insert the metal M into the mold 10 under pressure. That is, by way of a non-limiting example, the valve 50 of the mold 10 may first be actuated by the rod 58 to the open position (shown at 54 in FIG. 13). Then, the mold 10 may be inserted into the pressurized second furnace 66 containing the metal M so that the metal M may be inserted into the open spaces of the mold 10, i.e., the interconnected ducts 40 and voids 24 and interconnected feed conduits 34 and channels 28, under pressure in a flow defined by minimized turbulence.

More specifically, described with reference to FIG. 1, the metal M (FIG. 13) may enter one duct 40 and one feed channel 28 simultaneously. Since the duct 40 is interconnected with the at least one void 24 of one lamination stack 20, the metal M may exhibit flow defined by minimized turbulence from the duct 40 to the at least one void 24 and thereby pre-form the rotor bars 14 (FIG. 4) of the plurality of rotors 12 (FIG. 4). Thereafter, the metal M may travel from the at least one void 24 to the next adjacent duct 40 in a direction parallel to the central longitudinal axis A so that metal M filling each duct 40 pre-forms two rotor end rings 16 (FIG. 4) abutting the core 18 of the rotor 12 (FIG. 4).

Likewise, with continued reference to FIG. 1, since the channel 28 is interconnected with the feed conduit 34, the metal M (FIG. 13) may exhibit flow defined by minimized turbulence from the feed conduit 34 to the channel 28 and thereby pre-form an interior 74 (FIG. 4) of the rotor 12, which may be further finished or machined if desired.

In another variation, described with reference to FIG. 13, counter-gravity filling may draw the metal M having flow defined by minimized turbulence into the mold 10 under vacuum progressively along the central longitudinal axis A from the distal end 56 to the proximal end 62 of the mold 10. That is, by way of a non-limiting example, the valve 50 of the mold 10 may be actuated by the rod 58 to the open position (shown at 54 in FIG. 13), and the mold 10 may be inserted into the second furnace 66 to draw the metal M into the open spaces of the mold 10, i.e., the interconnected ducts 40 (FIG. 1) and voids 24 (FIG. 1) and interconnected feed conduits 34 (FIG. 1) and channels 28 (FIG. 1), under vacuum in a flow defined by minimized turbulence. Thereafter, the valve 50 of the mold 10 may be actuated by the rod 58 to the sealed position (shown at 52 in FIG. 13), and the workpiece 72 may be removed from the second furnace 66.

Referring to FIG. 13, the method may further include preheating the mold 10 to the first temperature, $T_1$, of from about 500° C. to about 1,300° C., e.g., about 660° C. for applications including aluminum or aluminum alloys and about 1,150° C. for applications including copper or copper alloys, before counter-gravity filling. For example, the mold 10 may be pre-heated to the first temperature, $T_1$, by the first furnace 64. Therefore, the first furnace 64 may be co-located with the second furnace 66 so that minimal time elapses between pre-heating and counter-gravity filling.

Figure 14:
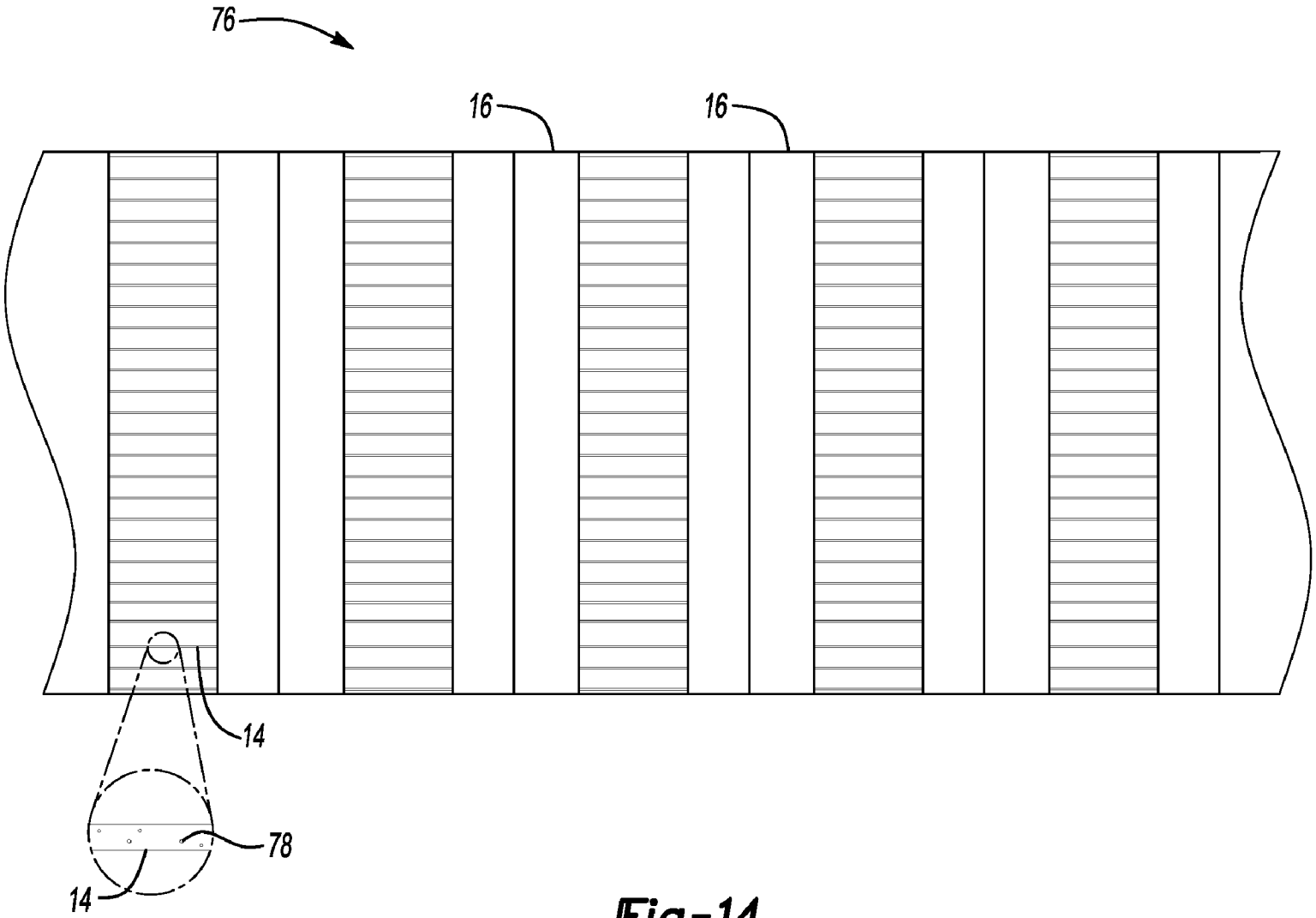
FIG. 14 is a schematic fragmentary side view of a portion of a cast formed from the mold system of FIG. 13 including a cut-away view of the cast defining a plurality of pores.

Referring to FIGS. 13 and 14, the method also includes quenching the workpiece 72 progressively along the central longitudinal axis A to directionally solidify the metal M along the central longitudinal axis A and thereby form a cast 76 (FIG. 14). As used herein, the terminology "cast" refers to an immediate precursor to the plurality of rotors 12 (FIG. 4). That is, referring to FIGS. 1 and 13, after the mold 10 is counter-gravity filled so that the metal M is disposed within each void 24, channel 28, feed conduit 34, and duct 40, the cooling device 68 may quench the workpiece 72 progressively along the central longitudinal axis A in a direction from the distal end 56 of the mold 10 to the proximal end 62 of the mold 10 to transition the metal M to the solid state and thereby form the cast 76 (FIG. 14) disposed within the mold 10.

Therefore, by way of a non-limiting example, with the valve 50 still actuated in the sealed position (shown at 52 in FIG. 13), the workpiece 72 may be removed from the second furnace 66 and inserted into the cooling device 68 for quenching. In particular, the workpiece 72 may be removed from the second furnace 66 without re-entry into the first furnace 64, moved above the cooling device 68 by the linear actuator 70, and inserted into the cooling device 68 for quenching. Alternatively, in another non-limiting example (not shown), the workpiece 72 may remain at a fixed horizontal position while the second furnace 66 and/or the cooling device 68 translate horizontally via, for example, the linear actuator 70. Stated differently, each of the workpiece 72, the first furnace 64, the second furnace 66, and/or the cooling device 68 may move, e.g., translate horizontally and/or vertically, with respect to each other. Therefore, the second furnace 66 and the cooling device 68 may be co-located so that minimal time elapses between counter-gravity filling and quenching.

The method may further include cooling the workpiece 72 after quenching. For example, after the mold 10 is quenched with the cooling device 68, the workpiece 72 may be removed from the cooling device 68 and cooled in an ambient environment. That is, after the mold 10 is quenched with the cooling device 68, the workpiece 72 may be removed from the cooling device 68 and not re-enter the first furnace 64.

Referring to FIG. 14, after quenching, the resulting cast 76 may have the shape of a plurality of rotors 12 (FIG. 4) stacked and connected end ring 16-to-end ring 16 (FIG. 4). Consequently, the cast 76 may have a length approximately equivalent to a length of the mold 10 (FIG. 13).

With continued reference to FIG. 14, since the method includes counter-gravity filling the mold 10 with the metal M having flow defined by minimized turbulence progressively along the central longitudinal axis A of the mold 10, the cast 76 defines a plurality of pores 78. In particular, the plurality of pores 78 are present in the cast 76 in an amount of from about 0.001 parts by volume to about 5 parts by volume based on 100 parts by volume of the cast 76. Therefore, the cast 76 has minimized porosity. Without intending to be limited by theory, counter-gravity filling of the mold 10 with the metal M having flow defined by minimized turbulence, and progressively solidifying the metal M along the central longitudinal axis A contributes to the minimized porosity of the cast 76.

The method additionally includes finishing the cast 76 (FIG. 14) to form the plurality of rotors 12 (FIG. 4). Finishing may be further defined as separating the cast 76 (FIG. 14) and the mold 10 (FIG. 1). For example, referring to FIG. 6, the first portion 42 of the shell 36 may be removed from the second portion 42B of the shell 36 for access to the cast 76 (FIG. 14), and the cast 76 (FIG. 14) may be removed from the first portion 42 (FIG. 6) of the shell 36 to thereby form the plurality of rotors 12 (FIG. 4).

In another variation, finishing may be further defined as machining the cast 76 (FIG. 14) to form the plurality of rotors 12 (FIG. 4). That is, each one of the rotors 12 (FIG. 4) may be machined so as to separate the rotor 12 (FIG. 4) from the cast 76 (FIG. 14) to form the plurality of rotors 12 (FIG. 4).

The mold 10, mold system 60, and method allow for counter-gravity filling of the mold 10 with the metal M having flow defined by minimized turbulence, and directional solidification of the metal M during formation of the rotors 12. Therefore, the mold 10, mold system 60, and method form a plurality of rotors 12 each having minimized porosity, excellent strength, minimized hot tears and shrinkage defects, and maximized conductivity. Consequently, the mold 10, mold system 60, and method form rotors 12 that are easily balanced in electric machines and are therefore useful for applications requiring excellent electric machine efficiency. Further, the method forms rotors 12 at low-pressure using economical tooling, and provides excellent metal yield. The mold 10, mold system 60, and method also form a plurality of rotors 12 at once and thereby optimize rotor production speed.

While the best modes for carrying out the disclosure have been described in detail, those familiar with the art to which this disclosure relates will recognize various alternative designs and embodiments for practicing the disclosure within the scope of the appended claims.

The invention claimed is:

1. A mold for forming a plurality of rotors, the mold comprising:

a plurality of lamination stacks, wherein each lamination stack defines at least one void therethrough;

a tube having a central longitudinal axis, wherein each lamination stack is concentrically spaced apart from said tube to define a channel therebetween;

a plurality of washers each having a shape defined by a first diameter and a second diameter that is greater than said first diameter, wherein each washer is configured to concentrically abut said tube and define a feed conduit interconnecting with said channel; and a shell disposed in contact with each lamination stack and concentrically spaced apart from each washer to define a plurality of ducts, wherein each duct is interconnected with said at least one void of at least one lamination stack.

2. The mold of claim 1, further including a plurality of spacers each having a shape defined by an internal diameter, wherein each spacer abuts one lamination stack and is concentrically spaced apart from said tube and disposed within said channel.

3. The mold of claim 2, wherein said first diameter is less than said internal diameter and said second diameter is greater than said internal diameter.

4. The mold of claim 1, further including a plurality of spacers each having a shape defined by an internal diameter and a third diameter that is less than said internal diameter and less than or equal to said first diameter, wherein each spacer abuts one lamination stack and said tube and is disposed within said channel.

5. The mold of claim 2, further including a member having a shape defined by a fourth diameter that is less than said internal diameter.

6. The mold of claim 1, including at least one feed conduit interconnecting exactly two channels.

7. The mold of claim 1, wherein one duct is interconnected with said at least one void of exactly two lamination stacks.

8. The mold of claim 1, wherein each washer includes four lobes defined by said first diameter and said second diameter.

9. The mold of claim 1, wherein said shell is separatable into a first portion and a second portion.

10. The mold of claim 1, further including a valve configured for sealing the mold.

11. The mold of claim 10, further including a rod disposed within said tube along said central longitudinal axis and configured for actuating said valve.

* * * * *